US005884694A

United States Patent [19]

Tanenbaum

[11] Patent Number: 5,884,694

[45] Date of Patent: Mar. 23, 1999

[54] BATHROOM DEHUMIDIFIER METHOD AND APPARATUS

[76] Inventor: Aaron Tanenbaum, 5385 Peachtree-Dunwoody Rd., Apt. 216, Atlanta, Ga. 30342

[21] Appl. No.: 824,507

[22] Filed: Mar. 26, 1997

[51] Int. Cl.[6] ..... F24F 13/22

[52] U.S. Cl. ..... 165/125; 165/50; 165/53; 165/66; 165/228; 4/545

[58] Field of Search ..... 165/50, 53, 125, 165/48.1, 66, 228; 4/545

[56] References Cited

U.S. PATENT DOCUMENTS

| | | | |
|---|---|---|---|
| 1,903,939 | 4/1933 | Payne | 165/125 |
| 2,044,832 | 6/1936 | Child | 165/125 |
| 2,159,913 | 5/1939 | Tenney | 165/125 |
| 2,260,594 | 10/1941 | Young | 165/125 |
| 2,267,425 | 12/1941 | Rowe et al. | 165/125 |
| 2,318,393 | 5/1943 | Honerkamp et al. | 165/125 |
| 2,504,798 | 4/1950 | Brinen | 165/125 |

*Primary Examiner*—Ira S. Lazarus
*Assistant Examiner*—Terrell McKinnon
*Attorney, Agent, or Firm*—James B. Middleton

[57] ABSTRACT

A dehumidifier for use in a bathroom or the like utilizes the cold surface of a heat exchanger to condense moisture, and the hot surface of a heat exchanger to warm the air after the moisture is removed. The cold surface is provided by having the cold water supplied to the room pass through the cold heat exchanger; and, the hot surface is provided by having the hot water supplied to the room head pass through the hot heat exchanger. The heat exchangers may be concentric circles, so a recirculation fan centrally of the heat exchangers will move air across the two, or may be rectangular with a plenum at each end so air moves across the two. A drip pan beneath the cold heat exchanger catches the condensate. The circular heat exchangers may be less than a full circle, and a light housed in the space defined. Also, an exhaust fan may be mounted concentrically with the recirculation fan in the circular heat exchanger, or may be mounted in the output plenum of the rectangular device.

19 Claims, 3 Drawing Sheets

BATHROOM DEHUMIDIFIER METHOD AND APPARATUS

BACKGROUND OF THE INVENTION

1. Field of the Invention

This invention relates generally to dehumidifiers and the like, and is more particularly concerned with a dehumidifier for use where there is a shower or the like, the warm and cold surfaces of the dehumidifier being provided by water flowing to the shower.

2. Discussion of the Prior Art

It has long been recognized that, in bathrooms and the like where one runs hot water to a considerable extent, as when bathing, the room becomes filled with water vapor. This vapor becomes a nuisance because it condenses on walls and ceilings, and on mirrors so a person cannot easily use the mirror while combing hair, shaving, applying make-up or the like.

The most common technique for clearing the air to prevent the mirrors from fogging is to utilize an exhaust fan. The exhaust fan will simply exhaust the moist air from the room, and replace it with air from adjacent rooms which may be cooler, and hopefully with lower water content. It will be understood, however, that a large volume of air must be moved by the exhaust fan to accomplish the task because the exhaust fan must replace all the air in the room often enough to maintain the humidity at the lower level. This requires a relatively large amount of power, and also creates sufficient air flow that one may be uncomfortably cold immediately on leaving the warm bathing water.

Another well known technique for de-humidifying air (though it is not normally used in a bathroom) is the use of a dehumidifier. The conventional dehumidifier utilizes a refrigeration system wherein the evaporator acts as a cold surface on which moisture condenses, and the condenser acts as a heat exchanger to re-warm the air before the air passes back into the room. Such dehumidifiers require more power than just a fan, and are usually too large to be used conveniently in a bathroom.

Thus, the prior art has not provided a simple and economical means for dehumidifying a room where one is bathing or otherwise running a rather large volume of hot water.

SUMMARY OF THE INVENTION

The present invention provides a method and apparatus for dehumidifying a room wherein one is running a large volume of hot water, the method comprising the step of passing the incoming cold water through a heat exchanger for providing a cold surface to cause moisture to condense from the air, passing the incoming hot water through another heat exchanger to provide a hot surface, and forcing humid air in the room across the cold surface, then across the hot surface, for dehumidifying and reheating the air.

The preferred embodiment of the invention includes a fan for causing the air to circulate, and has a first heat exchanger for receiving cold water from the cold water supply, the cold water going from the first heat exchanger to the supply side of the water heater, or to the point of use. There is a second heat exchanger adjacent to the first heat exchanger for receiving hot water from the water heater or other source of hot water, the hot water going from the second heat exchanger to the point of use. The fan moves the incoming air across the first heat exchanger where the moisture is condensed to dry the air, then across the second heat exchanger where the air is re-heated. The air then returns to the room.

In one embodiment of the invention, there may be an exhaust fan that is operable only when the dehumidifier is not in use.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
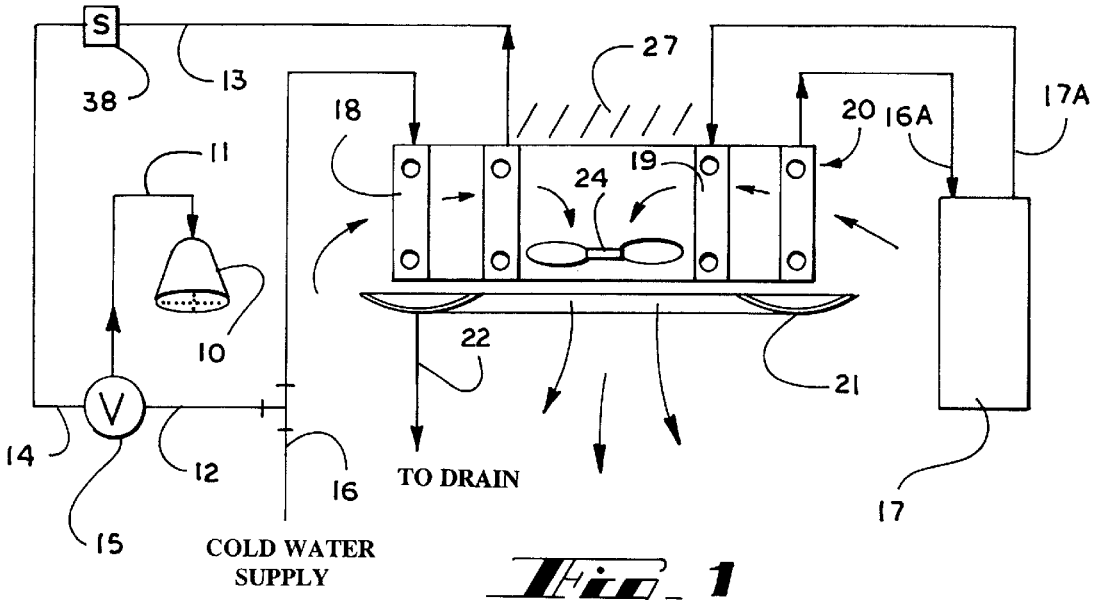
FIG. 1 is a schematic illustration showing a dehumidifying system made in accordance with the present invention.

Referring now more particularly to the drawings, and to those embodiments of the invention here presented by way of illustration, FIG. 1 is a schematic diagram showing a dehumidifying system. For purposes of illustration, it is assumed that the room to be dehumidified is a bathroom or the like, having a shower, represented by the shower head 10. Those skilled in the art will readily recognize that the room may be any other room wherein large amounts of hot water are run, and the source of the water vapor may be a bath tub, a dishwasher or other user of hot water.

The shower head 10 is supplied with water through a pipe 11 as is conventional; and, the pipe 11 is connected to a cold water line 12 and a hot water line 14. A valve 15 is included to control the cold and hot water flow as is well known in the art. It will be noticed that the line 12 is fed from the cold water supply 16, and the supply 16 continues and is connected to a heat exchanger 18. After passing through the heat exchanger 18, the water exits from the heat exchanger and enters a water heater 17 at 16A. The water in the heater 17 is raised to the desired "hot" temperature. Water then leaves the water heater 17 at 17A and enters a heat exchanger 19; and, from the heat exchanger 19 the water passes through the hot water supply pipe 13 and to the line 14 and the shower head 10.

The heat exchangers 18 and 19 are parts of the dehumidifying apparatus generally designated at 20. While the dehumidifier can easily take many forms, it is here shown as generally circular, and the schematic representation in FIG. 1 shows the device as in cross-section. This is convenient because the heat exchanger 19 can be placed concentrically inside the heat exchanger 18; but, the heat exchangers could be made flat, and placed side by side to achieve the same result. Those skilled in the art will determine many other arrangements to achieve the same function.

The dehumidifier 20 includes the cold heat exchanger 18 which has an annular drip pan 21 therebeneath. A drain line 22 is provided so water caught by the drip pan 21 will be directed to a disposal line, perhaps the shower drain. There is also the hot heat exchanger 19 inwardly of the heat exchanger 18; and, centrally of the heat exchanger 19, there is a fan 24 to move air through the device. As is indicated in FIG. 1, the fan 24 discharges air down, into the room being dehumidified. The suction side of the fan, then, pulls air from the room and over the coils of the two heat exchangers 18 and 19.

From the above discussion it should be understood that cold water will flow from the supply 16, through the cold water line 12 and to the shower head 10. Cold water will also flow from the supply 16, through the heat exchanger 18, then to the water heater 17. Water from the water heater 17 provides hot water to the hot water supply pipe 13, and to the hot water line 14 and the shower head 10. Realizing that the greater volume of water used at the shower head is hot water, the present arrangement provides a high flow rate of cold water through the heat exchanger 18 by passing the water heater replacement water through the heat exchanger 18. Additionally of course the water passing through the heat exchanger 18 is somewhat heated, thereby reducing the load on the water heater 17. Water is directed from the water heater 17, through the heat exchanger 19 to warm the coils in the heat exchanger 19.

As the shower head 10 discharges warm water into the air, the air will be warmed and filled with moisture. When the fan 24 is operating, air will be drawn in from the room and passed over the cold heat exchanger 18. In accordance with well known rules of physics, moisture will condense on the coils of the cold heat exchanger 18, and will drip down into the drip pan 21. Thus, moisture will be removed from the air, but the temperature of the air will be lowered. The drier and cooler air is next passed over the hot heat exchanger 19 where the air is heated. Again, as is well known in the art, the increase in temperature both warms the air for comfort, and further lowers the humidity before the air is returned to the room.

Figure 2:
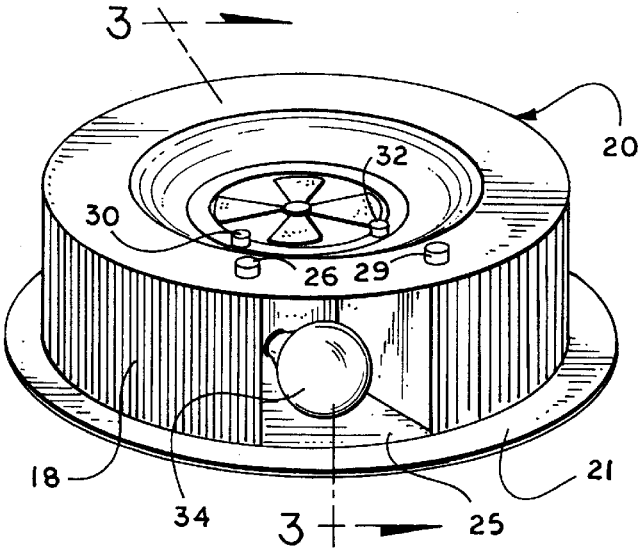
FIG. 2 is a perspective view showing a dehumidifying apparatus made in accordance with the present invention.
Figure 3:
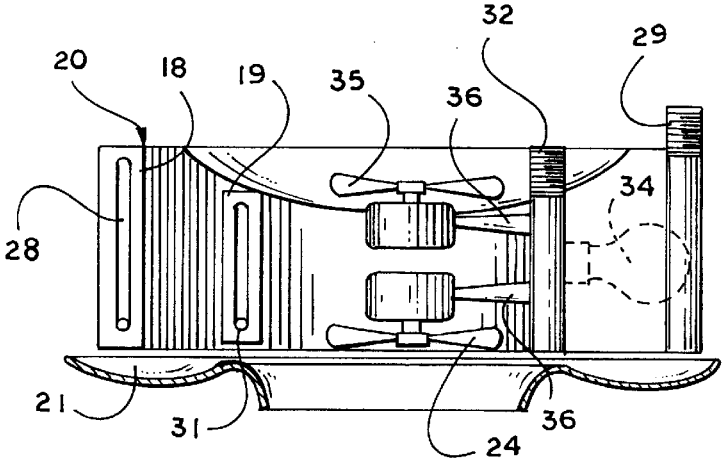
FIG. 3 is a cross-sectional view taken along the line 3—3 in FIG. 2.

Attention is now directed to FIGS. 2 and 3 for a discussion of the apparatus of the present invention. It will be noted that the dehumidifier 20 is generally circular in shape; but, the heat exchanger 18 occupies less than 360° to define a chamber 25. The heat exchanger 18 has a header 26 which is connected to one end of the coil 28 (FIG. 3). The coil 28 extends around the dehumidifier 20, and terminates at the opposite header 29. Similarly, the heat exchanger 19 has a header 30 which is connected to one end of the coil 31. The coil 31 extends around the dehumidifier and terminates at the opposite header 32.

As here shown, the chamber 25 houses a light 34. Those skilled in the art will understand that other electric appliances could be used, e.g. a radio. While the provision of an appliance is convenient, allowing one electrical device to fulfill several functions, the appliance may of course be omitted, and the heat exchangers could then extend over the full circle.

As is shown in FIG. 3 of the drawings, one embodiment of the invention here shown includes two fans. There is the air recirculating fan 24 that has been previously discussed, and an exhaust fan 35 that is generally coaxial with the fan 24. It will be noticed that the motors for the two fans 24 and 35 are mounted centrally of the dehumidifier 20, supported as by brackets 36 or the like.

In looking at the two fans 24 and 35, it will be readily understood that, when the exhaust fan 35 is operating, air may be pulled through the heat exchangers 18 and 19, as well as through the fan 24, but all the air is from the room so there is no problem. However, when the recirculating fan 24 is operating, some air may be drawn in through the exhaust fan 35, and this air may be from outside the room. This would lower the efficiency of the system, so one may wish to use a louver 27 or the like to cover the exhaust fan 35. An automatic louver, for example, would allow free air-flow out, but restrict air-flow inward. Such arrangements are well known to those skilled in the art, and no further description is thought to be necessary.

Figure 4:
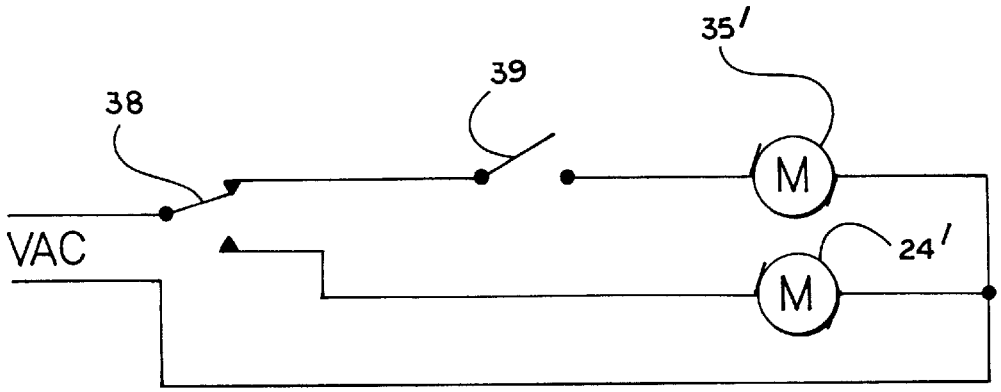
FIGS. 4 and 5 are schematic circuit diagrams showing electrical controls for the dehumidifier shown in FIGS. 2 and 3.

An electrical control circuit for the above described system is shown in FIG. 4. The motors 24' and 35' are for operating the fans 24 and 35 respectively. For selecting one of the fans, there is a single-pole-double-throw switch 38; and, as is shown in FIG. 1 of the drawings, there is a flow switch 38 in the hot water supply pipe 13. Thus, when there is water flow through the hot water supply pipe 13 and the line 14, the switch 38 will be in its transferred position to energize the motor 24', When the valve 15 is closed, so there is no flow, the switch 38 will be in its normal position as shown in FIG. 4, and the motor 35' may be energized. It will be noticed, however, that there is another switch 39, in series between the switch 38 and the motor 35'. The switch 39 may be a conventional wall switch to operate the exhaust fan 35.

Figure 5:
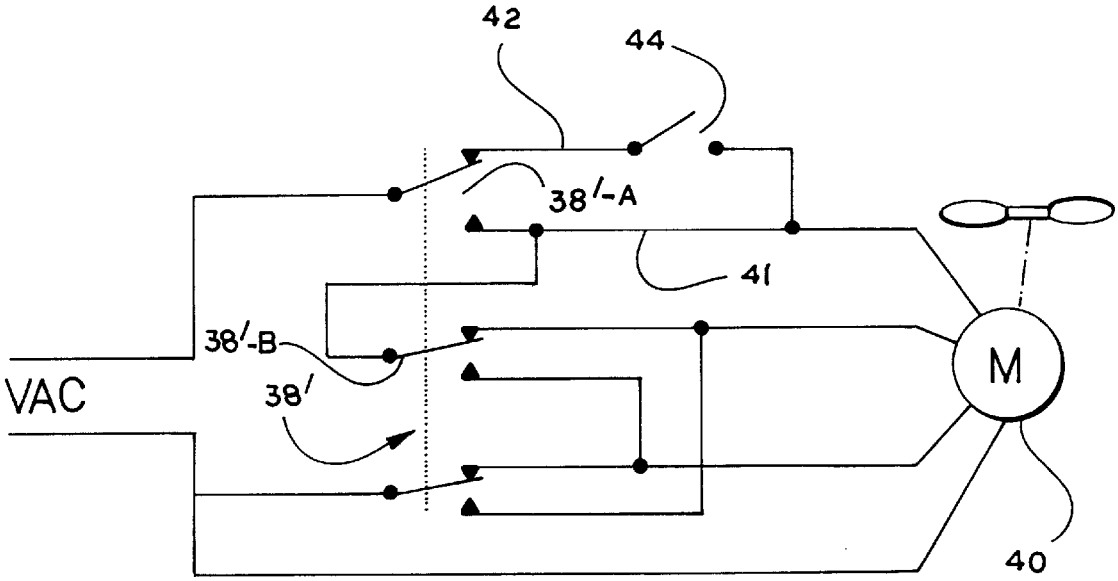

An alternative electrical control circuit is shown in FIG. 5 of the drawings, the FIG. 5 circuit including a single fan motor 40 for both recirculating and exhaust fans. The fan motor 40 is reversible by swapping the leads to the starting winding and the running winding as is well known, so the starting winding is connected to a double-pole-double-throw switch arrangement in conventional manner. However, since the motor 40 must turn on automatically when in the recirculation mode, a third pole is added to the switch, which is designated at 38'. Considering the switch 38' to be in the position of the flow switch 38, when water flows, the switch 38' will be transferred, and power will be applied through the contact 38'-A along the line 41 to the running winding of the motor 40. Also, the voltage will be applied from the line 41 to the common point of contact 38'-B, then to the starting winding of the motor 40. When no water is flowing, the switch 38' will be in its normal position, and current must flow through the line 42. As a result, the switch 44 can control operation of the exhaust fan.

While the above discussion has considered the switches 38 and 38' as flow switches, it must be understood that the object is to energize the recirculation fan when needed, and many conditions may be sensed to achieve this objective. For example, the switch 38' may be a temperature sensitive switch that will be transferred when water in the line 13 is hot. The switch may be operated by a humidistat when the humidity in the room is above a predetermined level. Other sensors may be used as desired to achieve the objective.

Figure 6:
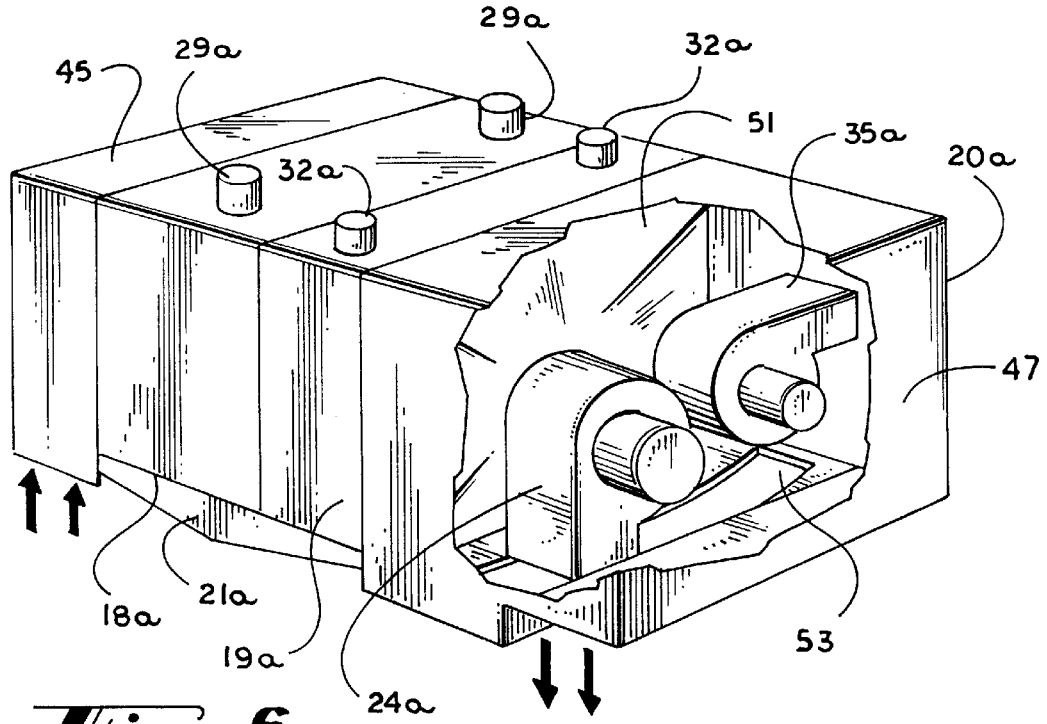
FIG. 6 is a perspective view, partially broken away, showing another form of dehumidifier made in accordance with the present invention; and, FIG. 7 is a plan view of a grille for use with the dehumidifier shown in FIG. 6.
Figure 7:
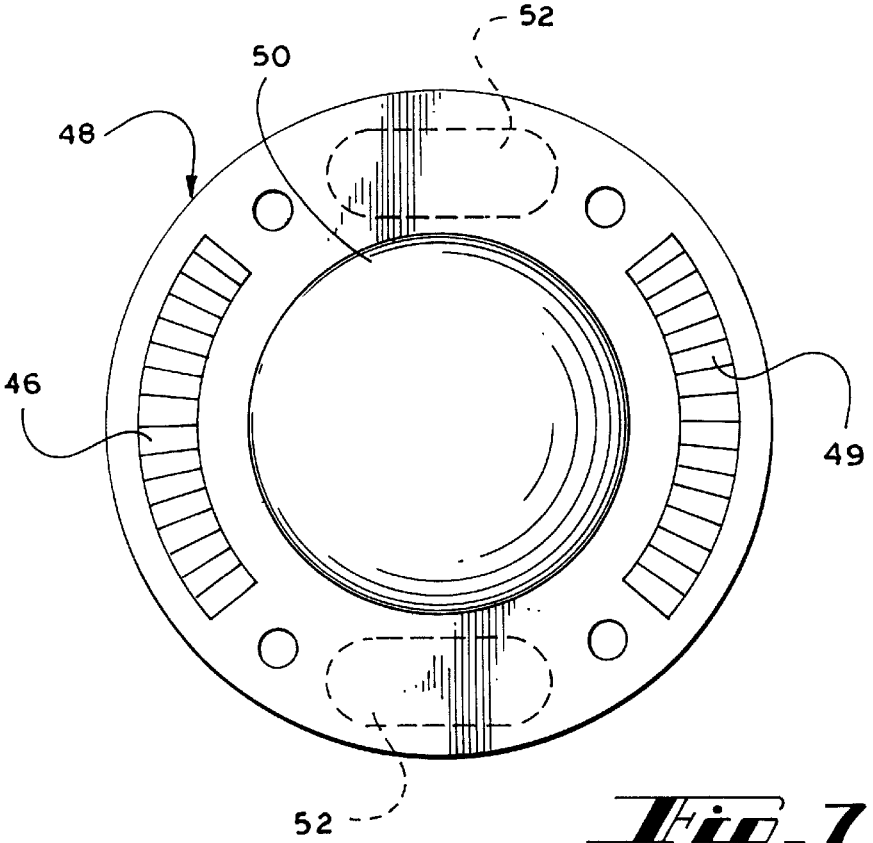

Attention is now directed to FIGS. 6 and 7 which disclose a modified form of dehumidifier made in accordance with the present invention. Parts similar to those in FIGS. 1–3 carry the same numerals with an a suffix. In FIG. 6 it will be noticed that the dehumidifier **20*a* is generally rectangular rather than circular as in the previously described embodiment. The arrangement, then, includes an intake plenum 45 at one end of the device, the plenum 45 having its bottom open. The cold heat exchanger 18*a* is contiguous with the plenum 45 to receive air directly from the plenum 45; and, the hot heat exchanger 19*a* is contiguous with the cold heat exchanger 18*a*. The opposite end of the device includes the output plenum 47, which houses both a recirculating fan 24*a* and an exhaust fan 35*a***.

Even though the dehumidifier **20*a* is rectangular, the face plate that is visible from inside the bathroom or the like is circular as shown in FIG. 7. The rectangular plenum 45 will sit over the curved grille 46 of the face plate 48. Similarly, the rectangular plenum 47 will sit over the curved grille 49. One may then mount a circular light 50 centrally of the face plate 48**. Such lights are readily available and are well known to those skilled in the art, so no further discussion is necessary.

Looking at FIG. 6 and the output plenum 47, the recirculating fan 24*a* is here shown as a centrifugal blower. The intake, or suction side, of the blower 24*a* is connected to the hot heat exchanger by a transition member 51 which is rectangular on one end to cover the rectangular heat exchanger 19*a*, and is circular on the other end to attach to the circular opening of the blower 24*a*. As a result, it will be understood that, when the blower 24*a* is operating, air will by discharged down through the grille 49. Air will be pulled into the intake plenum 45, across the two heat exchangers 18*a* and 19*a*, through the member 51 and to the blower 24*a*.

The plenums 45 and 47 extend down, somewhat below the heat exchangers 18*a* and 19*a*; and, in the space between the plenums 45 and 47 there is a drip pan 21*a* to receive the condensate from the cold heat exchanger 18*a*. There will be a drain line as shown in FIG. 1.

In this modif ied form of the invention, the exhaust fan 35*a* comprises a centrifugal blower within the output plenum 47 and arranged to discharge to the outside of the device 20*a*. Since the suction side of the blower 35*a* is within the output plenum 47, operation of the blower 35*a* will cause air to flow to the plenum 47 through the grille 49, through the curved opening 53 shown in FIG. 6.

It will be understood that a control circuit such as that shown in FIG. 4 will be used for the device shown in FIG. 6. When the blower 24*a* is operating, air will be discharged down. A centrifugal blower generally discharges a narrow air stream, so there should be minimal direct cross-over of the discharge to the intake. When the exhaust blower 35*a* is operating, all the intake air will. pass through the grille 49 and the opening 53, and be discharged to the outside of the device 20*a*.

The face plate 48 may of course be other shapes if desired; however, with the round shape as shown there is adequate space for the two grilles 46 and 49, and the light 50, and there are spaces 52 that can be used for additional items such as audio speakers.

It will therefore be understood by those skilled in the art that the present invention provides a very economical method and apparatus for removing the excess moisture from bathrooms and the like. While the method involves the usual technique of condensing moisture on a cold surface, the cold surface is provided by the cold water that is already passing through the pipes, so no additional energy is required. The cooled air is then re-heated by the hot water already passing through the pipes, so, again, no additional energy is required. The only additional energy is the electric energy used for the fan 24, and this is quite small, probably equivalent to the energy used by the usual exhaust fan. While the hot water may be slightly cooled by the cooled air passing thereover, the water heater replacement water will be warmed by the warm, moisture-laden air passing thereover. As is indicated in FIGS. 3 and 6 of the drawings, the cold heat exchanger 18 or 18*a* is larger than the hot heat exchanger 19 or 19*a*. It is contemplated that the cold water will be noticeably heated in the heat exchanger 18, while the hot water will be very slightly cooled in the heat exchanger 19. As a result, there may be an overall energy savings.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

What is claimed as invention is:

1. A method for dehumidifying the air in a room wherein said room has running water that adds moisture to the air in said room, a cold water supply pipe and a hot water supply pipe for supplying water to said room, and a water heater for heating water for said hot water supply pipe, said method comprising the steps of passing cold water from said cold water supply pipe through a cold heat exchanger, passing hot water from said water heater and to said hot water supply pipe through a hot heat exchanger that is adjacent to said cold heat exchanger, and passing said air is said room through said cold heat exchanger then through said hot heat exchanger, and returning said air to the room.

2. A method as claimed in claim 1, and further including the step of collecting condensate from said cold heat exchanger and directing said condensate to a drain.

3. A dehumidifier in combination with a room having running water, wherein said running water adds moisture to the air in said room, said combination comprising a cold water supply pipe for supplying cold water to said room, a hot water supply pipe for supplying hot water to said room, a cold heat exchanger connected to said cold water supply pipe and a hot heat exchanger connected to said hot water supply pipe so that said running water passes through said cold and hot heat exchangers, said cold and hot heat exchangers being disposed adjacent to each other, and fan means for moving said air in said room across said cold heat exchanger, then across said hot heat exchanger.

4. The combination as claimed in claim 3, wherein said room includes a shower for providing said running water, said shower including a shower head, and a valve for controlling water flow to said shower head, a water heater for heating water connected to said hot water supply pipe, said cold heat exchanger being connected between said cold water supply pipe and said water heater, and said hot heat exchanger being connected between said water heater and said hot water supply pipe.

5. The combination as claimed in claim 4, and further including means for detecting the flow of water through said hot water supply pipe, and circuit means for causing said fan means to be energized when said flow of water is detected.

6. The combination as claimed in claim 4, and including a drip pan beneath said cold heat exchanger for catching condensate from said cold heat exchanger.

7. The combination as claimed in claim 5, and further including an exhaust fan for selectively exhausting air from said room.

8. The combination as claimed in claim 7, and including second circuit means for preventing energization of said exhaust fan while said fan means is energized.

9. A dehumidifier, for use in a room having running hot water and cold water, said dehumidifier comprising a cold heat exchanger for receiving said cold water therethrough, a hot heat exchanger adjacent to said cold heat exchanger for receiving said hot water therethrough, and a recirculating fan for moving air in said room across said cold heat exchanger and subsequently across said hot heat exchanger.

10. A dehumidifier as claimed in claim 9, wherein said cold heat exchanger is generally circular, said hot heat exchanger is generally circular and is concentric with said cold heat exchanger, and said recirculating fan is concentric with said heat exchangers.

11. A dehumidifier as claimed in claim 10, and further including an annular drip pan disposed beneath said cold heat exchanger for receiving condensate from said cold heat exchanger.

12. A dehumidifier as claimed in claim 10, and including an exhaust fan mounted concentrically with said recirculating fan and above said recirculating fan.

13. A dehumidifier as claimed in claim 12, wherein said room is a bathroom including a shower for utilizing said hot water and cold water, and including a cold water line and a hot water line connected to said shower, a cold water supply connected to said cold water line and said cold heat exchanger, water heating means connected to said cold heat exchanger and said hot heat exchanger, and a hot water supply connected between said hot heat exchanger and said hot water line.

14. A dehumidifier as claimed in claim 13, and further including switch means for energizing said recirculating fan when said shower is running.

15. A dehumidifier as claimed in claim 14, wherein said switch means prevents operation of said exhaust fan during operation of said recirculating fan.

16. A dehumidifier as claimed in claim 15, and further including an exhaust fan, said exhaust fan being selectively operable when said recirculating fan is not operating.

17. A dehumidifier as claimed in claim 16, wherein said recirculating fan comprises a first fan motor and a first fan blade driven by said motor, and said exhaust fan comprises a second fan motor and a second fan blade driven by said motor, said switch means connecting power selectively to said first fan motor and said second fan motor.

18. A dehumidifier as claimed in claim 16, wherein said recirculating fan and said exhaust fan comprise a single fan motor and a fan blade driven by said motor, said fan motor being reversible by said switch means.

19. A dehumidifier as claimed in claim 16, and further including a louver adjacent to said exhaust fan, said louver being closed during operation of said recirculating fan.

* * * * *